US008172011B2

(12) United States Patent
Tank

(10) Patent No.: US 8,172,011 B2
(45) Date of Patent: May 8, 2012

(54) CUTTING ELEMENT

(76) Inventor: Klaus Tank, Johannesburg (ZA)

( * ) Notice: Subject to any disclaimer, the term of this patent is extended or adjusted under 35 U.S.C. 154(b) by 834 days.

(21) Appl. No.: 12/183,091

(22) Filed: Jul. 31, 2008

(65) Prior Publication Data

US 2008/0282619 A1 Nov. 20, 2008

Related U.S. Application Data

(62) Division of application No. 10/545,172, filed as application No. PCT/IB2004/000347 on Feb. 11, 2004, now abandoned.

(30) Foreign Application Priority Data

Feb. 11, 2003 (ZA) ..... 2003/1130

(51) Int. Cl.

| | |
|---|---|
| ***E21B 10/36*** | (2006.01) |
| ***B24D 3/00*** | (2006.01) |
| ***B24D 11/00*** | (2006.01) |
| ***B24D 18/00*** | (2006.01) |
| ***C09K 3/14*** | (2006.01) |

(52) U.S. Cl. ..... 175/431; 175/426; 175/428; 175/430; 175/434; 51/293

(58) Field of Classification Search ..... 51/293, 51/307; 264/138, 145, 146, 153, 157; 175/426, 175/428, 430, 432

See application file for complete search history.

(56) References Cited

U.S. PATENT DOCUMENTS

| | | | | |
|---|---|---|---|---|
| 4,570,726 | A | 2/1986 | Hall | |
| 5,421,423 | A | 6/1995 | Huffstutler | |
| 5,630,479 | A | 5/1997 | Dennis | |
| 5,761,779 | A * | 6/1998 | Maruyama et al. | 29/899 |
| 5,813,105 | A * | 9/1998 | Littecke et al. | 29/411 |
| 6,059,054 | A * | 5/2000 | Portwood et al. | 175/430 |
| 6,148,938 | A | 11/2000 | Beaton | |
| 6,241,034 | B1 | 6/2001 | Steinke et al. | |
| 6,241,035 | B1 | 6/2001 | Portwood | |
| 6,270,548 | B1 | 8/2001 | Campbell et al. | |
| 6,620,375 | B1 | 9/2003 | Tank et al. | |
| 6,821,188 | B2 | 11/2004 | Tank et al. | |
| 7,070,011 | B2 | 7/2006 | Sherwood et al. | |
| 7,074,247 | B2 | 7/2006 | Tank et al. | |
| 2005/0155295 | A1 | 7/2005 | Tank | |

FOREIGN PATENT DOCUMENTS

| | | |
|---|---|---|
| EP | 0 473 403 | 3/1992 |
| WO | 00/36264 | 6/2000 |

OTHER PUBLICATIONS

U.S. Appl. No. 12/183,090, filed Jul. 31, 2008, Tank.

* cited by examiner

*Primary Examiner* — Anthony J Green

*Assistant Examiner* — Pegah Parvini

(74) *Attorney, Agent, or Firm* — Oblon, Spivak, McClelland, Maier & Neustadt, L.L.P.

(57) ABSTRACT

A method of manufacturing a tool component, which is typically a cutting element or a gauge stone in a rotary drill bit, including a layer of ultra-hard abrasive material bonded to a substrate, the layer of ultra-hard abrasive material comprising a pair of opposed end surfaces, an upper surface defined between the end surfaces, and at least one curved and tapered cutting edge defined at the intersection of the respective end surfaces and the upper surface. The respective cutting edges of the tool component and the respective end surfaces leading to the cutting edges are generally wedge-shaped, the upper surface of the layer following generally the same or a similar profile, at least in the region of the cutting edges.

14 Claims, 3 Drawing Sheets

CUTTING ELEMENT

CROSS-REFERENCE TO RELATED APPLICATIONS

This application is a Divisional of and claims the benefit of priority under 35 U.S.C. §120 from U.S. Ser. No. 10/545,172, filed Apr. 5, 2006, and is a National Stage of PCT/IB04/00347, filed Feb. 11, 2004 and claims the benefit of priority under 35 U.S.C. §119 from South Africa Patent Application No. 2003/1130, filed Feb. 11, 2003, the entire contents of each which are incorporated herein by reference.

BACKGROUND OF THE INVENTION

This invention relates to tool components.

Tool components, particularly cutting elements, in the form of composite abrasive compacts are well known in the art and used extensively in various cutting, drilling, milling and other abrasive operations. The tool components generally comprise a layer or table of ultra-hard abrasive material bonded to a cemented carbide substrate. The tool component has a generally cylindrical shape with the layer or table of ultra-hard abrasive material being bonded to one of two flat ends of a cylindrical substrate. The ultra-hard abrasive material is generally polycrystalline diamond (PCD) or polycrystalline cubic boron nitride (PCBN).

In use, the upper exposed peripheral edge of the layer or table of ultra-hard abrasive material is the edge which provides the cutting edge for the component. In drilling, for example, the cutting element is generally mounted at a negative rake angle relative to the direction of advancement of the component through the rock, as illustrated by FIG. 1 of the attached drawings. Referring to FIG. 1, the prior art cutting element comprises a layer 10 of ultra-hard abrasive material bonded to a cemented carbide substrate 12. The cutting element has a cylindrical shape. The peripheral edge 14 of the layer 10 provides the cutting edge for the element. FIG. 1 illustrates the cutting element advancing in the direction of arrow 16 into a rock face or other workpiece 18. In so advancing, a considerable load is placed on the front flat face 20 of the layer 10. This in turn creates a significant bending moment on the cutting element and hence stress on this element. This stress leads to fracture and spalling. U.S. Pat. No. 4,109,737 discloses a rotary drill bit for rock drilling which comprises a plurality of cutting elements mounted in a crown of the drill bit. Each cutting element comprises an elongate pin with a thin layer of crystalline diamond bonded to the free end of the pin. The layer of polycrystalline diamond presents a curved cutting surface for the drill bit.

SUMMARY OF THE INVENTION

According to the present invention, a tool component comprises a layer of ultra-hard abrasive material bonded to a substrate, the layer of ultra-hard abrasive material comprising a pair of opposed end surfaces, an upper surface defined between the end surfaces, and at least one curved and tapered cutting edge defined at the intersection of the respective end surfaces and the upper surface.

The end surfaces are preferably tapered complementary to the cutting edges.

The respective cutting edges of the tool component and the respective end surfaces leading to the cutting edges are generally wedge-shaped. This means that the cutting edges and end surfaces will have generally converging regions. It is preferred that the converging regions meet notionally beyond the cutting edges, thus providing the curved cutting edges.

The upper surface of the layer follows generally the same or a similar profile to that of the respective cutting edges, at least in the region of the cutting edges.

In one form of the invention, the tool component has an essentially cylindrical shape presenting opposite ends and a curved side surface, the layer of ultra-hard abrasive material being located in the curved side surface and presenting a curved upper surface.

In another form of the invention, the tool component has an essentially rectangular or cylindrical substrate to which is bonded a layer of ultra-hard abrasive material presenting a curved upper surface.

The interface between the layer of ultra-hard abrasive material and the substrate may be planar, curved or otherwise profiled.

The ultra-hard abrasive layer may be PCD, PCBN or CVD diamond.

The substrate will typically be a cemented carbide substrate, and preferably a cemented tungsten carbide substrate.

The tool component of the invention may be used for a variety of abrasive operations. Preferably, the tool component is used as a cutting element or as a gauge stone in a rotary drill bit for subterranean rock drilling.

BRIEF DESCRIPTION OF THE DRAWINGS

The invention will now be described in more detail, by way of example only, with reference to the accompanying drawings in which.

DESCRIPTION OF THE EMBODIMENTS

Embodiments of the invention will now be described with reference to the accompanying drawings. FIGS. 2 to 5 of the accompanying drawings illustrate different embodiments.

Figure 2:
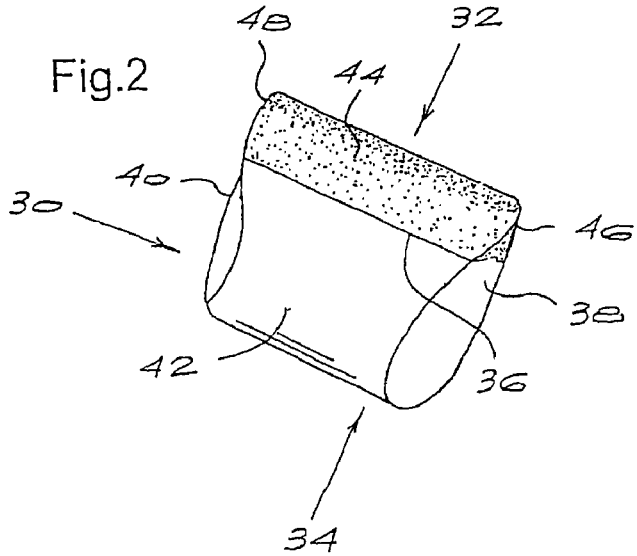
FIGS. 2 to 5 are perspective views of different embodiments of tool components of the invention.

Referring first to FIG. 2, a tool component 30, which is generally cylindrical, comprises a layer 32 of ultra-hard abrasive material bonded to a substrate 34. The interface 36 between the layer 32 and the substrate 34 is planar.

The tool component 30 has converging end surfaces 38, 40 and a curved side surface 42. The layer 32 of ultra-hard abrasive material is located lengthwise in the tool component. The layer 32 presents a curved upper surface 44 and curved and essentially wedge-shaped cutting edges 46, 48 defined at the intersection of the upper surface 44 and the respective end surfaces 38, 40.

Figure 3:
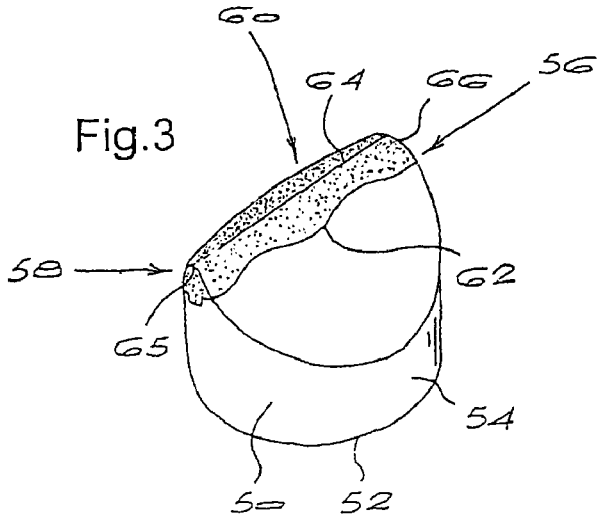

A second embodiment of the invention is illustrated by FIG. 3. Referring to this figure, a tool component comprises a cemented carbide substrate 50 which is generally cylindrical. The substrate 50 has a flat base surface 52, a curved side surface 54 and converging surfaces 56, 58. Located in and bonded to the substrate in the converging surfaces 56, 58 is a layer 60 of ultra-hard abrasive material. The layer 60 is bonded to the substrate 50 along profiled interface 62. The layer 60 has a wedge-shaped upper surface 64 and wedge-shaped cutting edges 65, 66.

Figure 4:
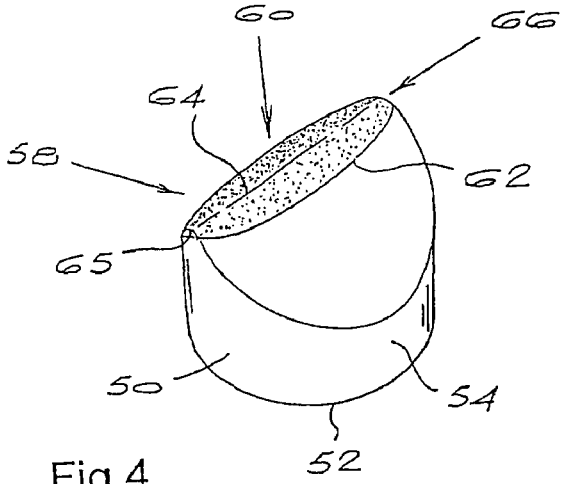

A third embodiment of the invention is illustrated by FIG. 4. This embodiment is similar to the embodiment of FIG. 3 and like parts carry like numerals. The difference with this embodiment is that the profiled interface 62 is essentially crescent-shaped.

Figure 5:
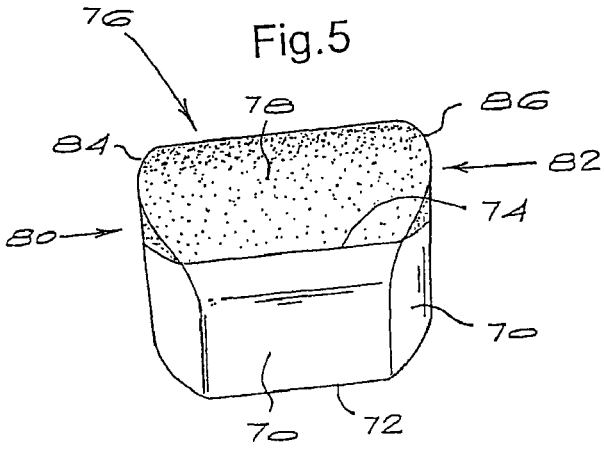

A fourth embodiment of the invention is illustrated by FIG. 5. Referring to this Figure, a tool component comprises a generally rectangular cemented carbide substrate 70 having a flat lower surface 72 and a flat upper surface 74. Bonded to the flat upper surface 74 is a layer 76 of ultra-hard abrasive material. The layer 76 has an upper curved surface 78. Further, the layer 76 has, at opposite ends thereof, converging surfaces 80, 82 and essentially wedge-shaped cutting edges 84, 86.

The tool components illustrated by FIGS. 2 to 5 are merely illustrative and not limiting. The curves of the various surfaces may vary as may the shapes of the interfaces between the layer of ultra-hard abrasive material and the substrate. The cutting edges may be sharp or radiused. In all variations, the tool component will retain its essentially curved and wedge-shaped cutting edge or edges and surfaces leading to the cutting edge or edges.

Figure 1:
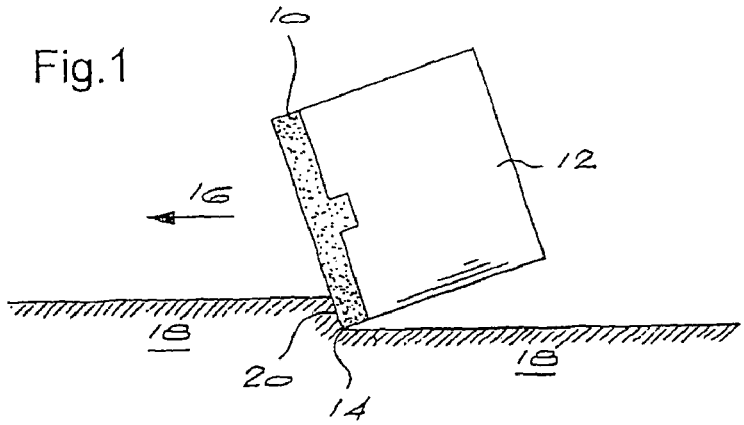
FIG. 1 is a sectional side view of a cutting element of the prior art, in use.
Figure 6:
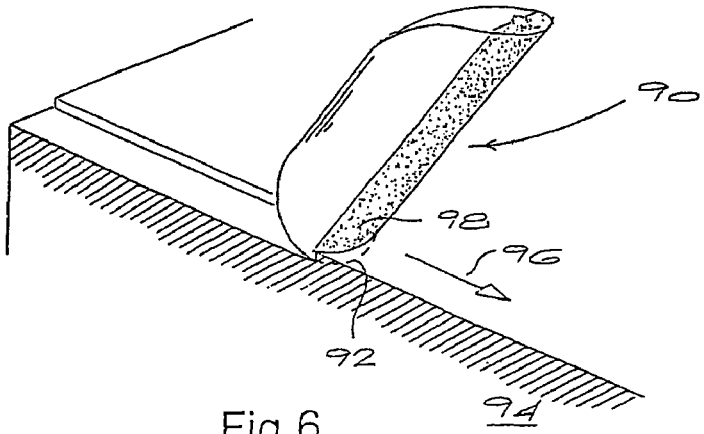
FIG. 6 is a perspective view of a tool component of the invention, in use cutting a workplace.
Figure 7:
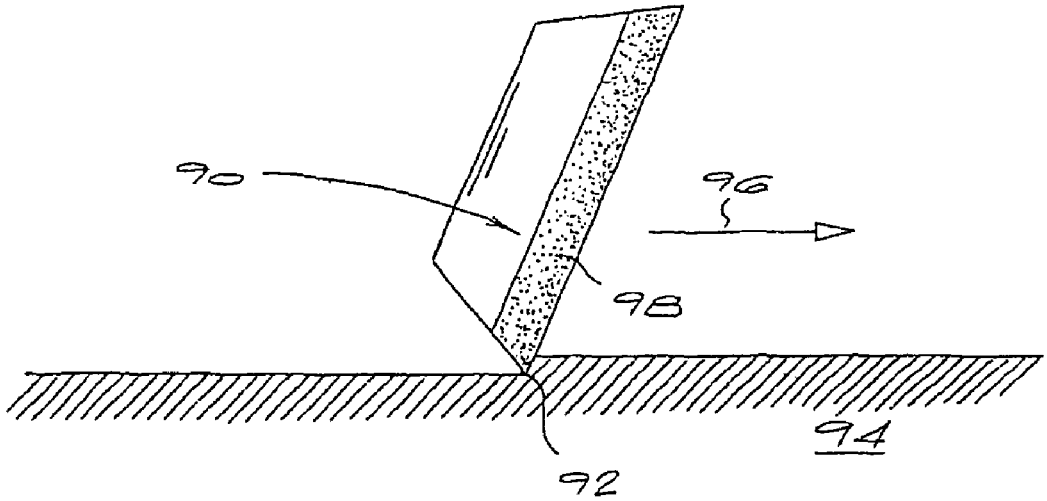
FIG. 7 is a side view of FIG. 6.

The tool components have particular application as cutting elements for rotary drill bits and as gauge stones for such bits. FIGS. 6 and 7 illustrate diagrammatically a tool component of FIG. 2 as a cutting element in a rotary drill bit. Referring to these Figures, the cutting element 90 is mounted in the crown of a drill bit. In use, leading cutting edge 92 carries out the cutting action on a rock formation or substrate 94. The tool component advances into the workpiece in the direction of arrow 96. The cutting action of the cutting edge is similar to that of the prior art cutting elements illustrated by FIG. 1. However, the essentially wedge-shape of the cutting edge 92, the curved surfaces leading to this cutting edge and the curved upper surface 98 reduces very substantially the load which is placed on the layer of ultra-hard abrasive material as it advances through the substrate in a similar fashion to the bow of a boat through a body of water. Accordingly, it reduces substantially the bending moment to which the cutting element is exposed.

Figure 8:
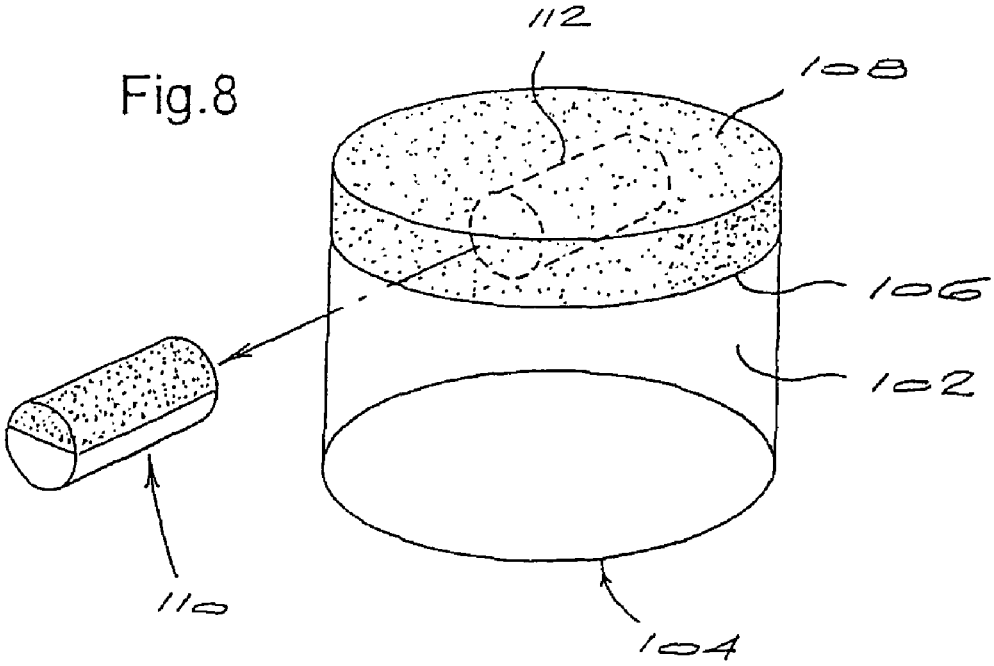
FIG. 8 is a perspective view of a body from which a tool component of the invention may be produced.

The tool components of the invention may be produced from a known ultra-hard abrasive material/substrate body as illustrated diagrammatically in FIG. 8. The body 100 comprises a substrate, generally a cemented carbide substrate 102 having a flat lower surface 104 and a flat upper surface 106. Bonded to the flat upper surface 106 is a layer 108 of ultra-hard abrasive material. The body is cylindrical in shape. A blank 110 may be cut from the body 100 as shown by the dotted lines 112. The cutting, as shown, is transverse to the longitudinal axis of the body 100 and through the interface between the layer 108 and substrate 102. The blank 110 may then be shaped to produce a tool component as shown, for example, by FIG. 2. This is merely illustrative of one way of making the tool components of the invention. Variations, such as variations in the profile of the interface between layer 108 and substrate 104, for example, would also fall within the ambit of this invention.

The invention claimed is:

1. A method of manufacturing a tool component including a layer of ultra-hard abrasive material bonded to a substrate, the layer of ultra-hard abrasive material including a pair of opposed end surfaces, an upper surface defined between the end surfaces, and at least one curved and tapered cutting edge defined at the intersection of the respective end surfaces and the upper surface, the method comprising:

providing a body including the layer of ultra-hard abrasive material bonded to the substrate along an interface which is transverse to a longitudinal axis of the body;

cutting a blank from the body transverse to a longitudinal axis of the body and through an interface between the layer of ultra-hard abrasive material and the substrate, the blank having a generally cylindrical shape and comprising a layer of ultra-hard abrasive material bonded lengthwise to a substrate layer; and shaping the blank into a desired shape for the tool component.

2. The method according to claim 1, wherein the end surfaces are made tapered complementary to the at least one cutting edge.

3. The method according to claim 2, wherein the respective at least one cutting edge and end surfaces are generally wedge-shaped.

4. The method according to claim 1, wherein the upper surface is made to follow generally the same or a similar profile to that of the respective at least one cutting edge, at least in the region of the at least one cutting edge.

5. The method according to claim 1, wherein the tool component is made to have an essentially cylindrical shape presenting opposite ends and a curved side surface, the layer of ultra-hard abrasive material being located in the curved side surface and presenting a curved upper surface.

6. The method according to claim 1, wherein the tool is made to comprise an essentially rectangular or cylindrical substrate to which the layer of ultra-hard abrasive material is bonded, the layer of ultra-hard abrasive material presenting a curved upper surface.

7. The method according to claim 1, wherein the interface between the layer of ultra-hard abrasive material and the substrate is planar, curved or otherwise profiled.

8. The method according to claim 1, wherein the layer of ultra-hard abrasive material is PCD, PCBN or CVD diamond.

9. The method according to claim 1, wherein the substrate is a cemented carbide substrate.

10. The method according to claim 9, wherein the substrate is a cemented tungsten carbide substrate.

11. The method according to claim 1, wherein the tool component comprises only one layer of ultra-hard abrasive material bonded lengthwise to a substrate layer.

12. The method according to claim 1, wherein the interface between the layer of ultra-hard abrasive material and the substrate is a single flat plane.

13. The method according to claim 1, wherein a length of the blank is greater than a diameter of the blank.

14. The method according to claim 1, wherein the blank is cut in a direction substantially parallel to the interface between the layer of ultra-hard abrasive material and the substrate.

* * * * *